US009081316B2

(12) United States Patent
Hong et al.

(10) Patent No.: US 9,081,316 B2
(45) Date of Patent: Jul. 14, 2015

(54) ELECTROPHOTOGRAPHIC TONER AND METHOD OF PREPARING THE SAME

(75) Inventors: Jin-mo Hong, Yongin-si (KR); Jae-hwan Kim, Seoul (KR); Kyeong Pang, Suwon-si (KR); Su-bum Park, Daegu (KR); Jeong-hyun Lee, Suwon-si (KR); Mi-rim Cho, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 627 days.

(21) Appl. No.: 12/882,439

(22) Filed: Sep. 15, 2010

(65) Prior Publication Data

US 2011/0151368 A1 Jun. 23, 2011

(30) Foreign Application Priority Data

Dec. 18, 2009 (KR) ..... 10-2009-0126927

(51) Int. Cl.

*G03G 9/08* (2006.01)
*G03G 9/087* (2006.01)
*G03G 9/093* (2006.01)

(52) U.S. Cl.

CPC ..... *G03G 9/08755* (2013.01); *G03G 9/0819* (2013.01); *G03G 9/0827* (2013.01); *G03G 9/08782* (2013.01); *G03G 9/08795* (2013.01); *G03G 9/08797* (2013.01); *G03G 9/09328* (2013.01); *G03G 9/09371* (2013.01); *G03G 9/09392* (2013.01); *G03G 9/081* (2013.01); *G03G 9/0802* (2013.01); *G03G 9/0804* (2013.01); *G03G 9/0806* (2013.01)

(58) Field of Classification Search

CPC ..... G03G 9/00; G03G 9/0819; G03G 9/0827; G03G 9/08755; G03G 9/08782; G03G 9/08795; G03G 9/08797; G03G 9/09328; G03G 9/09371; G03G 9/09392; G03G 9/0802; G03G 9/0804; G03G 9/0806; G03G 9/081

USPC ..... 430/96–126.2, 108.1, 109.1, 109.4, 430/110.1, 110.3, 137.1, 137.11, 137.12, 430/137.14, 137.17

See application file for complete search history.

(56) References Cited

U.S. PATENT DOCUMENTS

| | | | | |
|---|---|---|---|---|
| 6,617,091 | B2 | 9/2003 | Nishimori et al. | |
| 7,368,214 | B2 * | 5/2008 | Ishiyama et al. | 430/111.4 |
| 7,572,564 | B2 * | 8/2009 | Sato et al. | 430/108.4 |
| 2004/0241564 | A1 * | 12/2004 | Hidaka et al. | 430/108.4 |
| 2008/0096119 | A1 * | 4/2008 | Yamamoto et al. | 430/109.4 |
| 2008/0166649 | A1 * | 7/2008 | Moffat et al. | 430/108.8 |
| 2008/0187854 | A1 * | 8/2008 | Yoshida et al. | 430/109.4 |
| 2010/0196813 | A1 * | 8/2010 | Shin et al. | 430/108.4 |

* cited by examiner

*Primary Examiner* — Christopher Rodee
*Assistant Examiner* — Omar Kekia
(74) *Attorney, Agent, or Firm* — Staas & Halsey LLP

(57) ABSTRACT

An electrophotographic toner including a binder, a colorant and a releasing agent, and a method of preparing the electrophotographic toner.

15 Claims, 2 Drawing Sheets

ELECTROPHOTOGRAPHIC TONER AND METHOD OF PREPARING THE SAME

CROSS-REFERENCE TO RELATED APPLICATIONS

This application claims the benefit of Korean Patent Application No. 10-2009-0126927, filed on Dec. 18, 2009 in the Korean Intellectual Property Office, the disclosure of which is hereby incorporated by reference in its entirety for all purposes.

BACKGROUND

1. Field of the Invention

The present disclosure generally relates to an electrophotographic toner and a method of preparing the electrophotographic toner.

2. Description of the Related Art

Polymerized toner has been drawing more attention for use in developing electrophotographic and electrostatic latent images as compared to pulverized toner. This may due to the market demand for high-quality, high-reliability, and high-productivity digital color multi-functional printers and color printers that use polymerized toner. With the growing concerns of global warming, there has also been a demand for high-quality polymerized toner having a wide color gamut, small particle size, narrow particle size distribution, and low-temperature fixing characteristics in order to reduce energy consumption and $CO_2$ emissions.

Toner prepared by mixing and pulverizing processes has several limitations. In these processes, there is a limit to controlling toner structure and a huge amount of energy is required for preparing toner having smaller diameters. In addition, the cohesiveness and storage ability of pulverized toner may be degraded when a releasing agent, such as wax or a pigment, is exposed to the surface of toner. By contrast, polymerized toner may be obtained by aggregation and growth of source material particles and thus, it is straightforward to control the particle size distribution, circularity and morphology of toner. Polymerized toner also has higher resolution due to the ability to reproducibly form dots and lines and therefore, may be used in smaller amounts, thereby reducing energy consumption. Transfer efficiency and charging stability may also be improved with polymerized toner.

Polymerized toner is conventionally prepared by copolymerizing styrene and acrylate for use as the binder resin. Various applications for color resin require toner having high transparency and excellent low-temperature fixing characteristics. In order to improve these physical characteristics, methods for building a capsule structure including a core and a shell has been suggested. The suggested methods, however, may suppress the exposure of colorant to toner surface, thereby reducing the charge variation between different colors. If the amount of the releasing agent is high, a low-molecular weight releasing agent may be partially miscible with the resin, thereby causing toner to be plasticized. As a result, toner may have poor heat storage ability and flowability. For low-temperature fixing characteristics, methods for encapsulating a binder resin having a lower glass transition temperature ($T_g$) with a binder resin having a higher $T_g$ has been suggested. However, the heat storage stability of toner prepared using these methods may not be satisfactory, although the toner may have low-temperature fixing characteristics.

SUMMARY

The present disclosure provides an electrophotographic toner and methods for preparing the electrophotographic toner.

According to one aspect of the present disclosure, there is provided an electrophotographic toner including: a binder containing a crystalline polyester resin and an amorphous polyester resin; a colorant; and a releasing agent, wherein the areas and shapes of crystalline polyester resin domains and releasing agent domains in a total cross-section of toner satisfy the following inequalities (1)-(5), wherein the cross-section of toner is observed by transmission electron microscopy (TEM) after being stained with ruthenium tetraoxide ($RuO_4$):

$$0.5 \le DS(R)/DL(R) \le 1.0 \quad (1)$$

$$0.1 \le DS(C)/DL(C) \le 1.0 \quad (2)$$

$$0.4 \le R\kappa/R \le 1.0 \quad (3)$$

$$0.2 \le C_\lambda/C \le 1.0 \quad (4)$$

$$0.15 \le (R\kappa + C_\lambda)/T \le 0.5 \quad (5)$$

wherein DS(R) and DL(R) denote the shortest and longest diameters, respectively, of the releasing agent domains; and DS(C) and DL(C) denote the shortest and longest diameters, respectively, of the crystalline polyester resin domains, and R, Rκ, C, $C_\lambda$ and T denote the total area of the entire releasing agent domains, the total area of the releasing agent domains which satisfy the inequality (1), the total area of the entire crystalline polyester resin domains, the total area of the crystalline polyester resin domains which satisfy the inequality (2), and the total area of the entire cross-section of toner, respectively.

According to another aspect, the present disclosure provides an electrophotographic toner wherein the difference between an amorphous polyester resin's acid value (AV) and the crystalline polyester resin's AV satisfies the following inequality (6):

$$2 \le \text{amorphous polyester resin's } AV - \text{crystalline polyester resin's } AV \le 15 \quad (6)$$

wherein the amorphous polyester resin's AV and the crystalline polyester resin's AV means the number of milligrams (mg) of KOH required to neutralize 1 g of each of the amorphous polyester resin and the amorphous polyester resin.

According to another aspect, the present disclosure provides an electrophotographic toner wherein the volume average particle diameter of the electrophotographic toner may be in the range of about 3 to about 9.5 μm.

According to another aspect, the present disclosure provides an electrophotographic toner wherein the average circularity of the electrophotographic toner may be in the range of about 0.945 to about 0.985.

According to another aspect, the present disclosure provides an electrophotographic toner wherein the volume average particle diameter distribution coefficient (GSDv) of the toner may be about 1.25 or less, and the number average particle diameter distribution coefficient (GSDp) may be about 1.3 or less.

According to another aspect, the present disclosure provides an electrophotographic toner that may include iron (Fe) and silicon (Si), wherein the [Si]/[Fe] ratio is in the range of about $5.0\times10^{-4}$ to about $5.0\times10^{-2}$, wherein [Fe] and [Si] denote the intensities of Fe and Si, respectively, as measured by X-ray fluorescence spectrometry.

According to another aspect, the present disclosure provides an electrophotographic toner wherein when the particle diameter distribution of the electrophotographic toner is measured by the Coulter method, the electrophotographic toner may contain less than 3 wt % of fine particles having a volume average particle diameter of less than 3 μm, and less than 0.5 wt % of coarse particles having a volume average particle diameter of 16 μm or greater.

According to another aspect, the present disclosure provides an electrophotographic toner wherein the main endothermic peak of the electrophotographic toner may appear at a temperature of about 50 to about 150° C., as measured by scanning electron microscopy (DSC) according to ASTM D-3418-8.

According to another aspect, the present disclosure provides an electrophotographic toner wherein the releasing agent may include a paraffin-based wax and an ester-based wax.

According to another aspect, the present disclosure provides an electrophotographic toner wherein the amount of the ester-based wax may be in the range of about 1 to about 35 parts by weight % based on the total weight of the paraffin-based wax and the ester-based wax.

According to another aspect, the present disclosure provides an electrophotographic toner wherein the difference (SPB-SPR) between the solubility parameter of the binder (SPB) and the solubility parameter of the releasing agent (SPR) may be about 2 or greater.

According to another aspect, the present disclosure provides methods for preparing an electrophotographic toner, the method including: mixing primary binder particles, a colorant dispersion and a releasing agent dispersion together to thereby produce a mixed solution; adding an agglomerating agent to the mixed solution to thereby produce core-layer particles; and coating the core-layer particles with shell-layer particles including secondary binder particles to thereby produce toner particles, wherein the secondary binder particles are prepared by polymerizing at least one polymerizable monomer, wherein the electrophotographic toner includes the electrophotographic toner described herein.

According to another aspect, the present disclosure provides methods for preparing an electrophotographic toner wherein the producing of the toner particles may include: a) agglomerating the core-layer particles and the shell-layer particles at a temperature at which the core-layer particles and the shell-layer particles have a shear storage modulus (G') of about $1.0\times10^8$ to about $1.0\times10^9$ Pa; b) stopping the agglomerating of operation a) when an average particle diameter of the toner particles reaches about 70% to about 100% of the average particle diameter of toner particles; and c) fusing and coalescing the toner particles obtained in operation b) at a temperature at which the toner particles obtained in operated b) have a shear storage modulus (G') of about $1.0\times10^4$ to about $1.0\times10^9$ Pa.

According to another aspect, the present disclosure provides methods for preparing an electrophotographic toner further including coating the secondary toner particles with tertiary binder particles.

According to another aspect, the present disclosure provides methods for preparing an electrophotographic toner wherein the releasing agent dispersion may include a paraffin-based wax and an ester-based wax.

According to another aspect, the present disclosure provides methods for preparing an electrophotographic toner wherein the amount of the ester-based wax may be in the range of about 1 to about 35 parts by weight % based on the total weight of the paraffin-based wax and the ester-based wax.

According to another aspect, the present disclosure provides methods for preparing an electrophotographic toner wherein the agglomerating agent may include a Si- and Fe-containing metal salt.

According to another aspect, the present disclosure provides methods for preparing an electrophotographic toner wherein the agglomerating agent may include polysilicate iron.

BRIEF DESCRIPTION OF THE DRAWINGS

Various features and advantages of the present disclosure will become more apparent by describing in detail exemplary embodiments thereof with reference to the attached drawings.

DETAILED DESCRIPTION OF THE EMBODIMENTS

Figure 1:
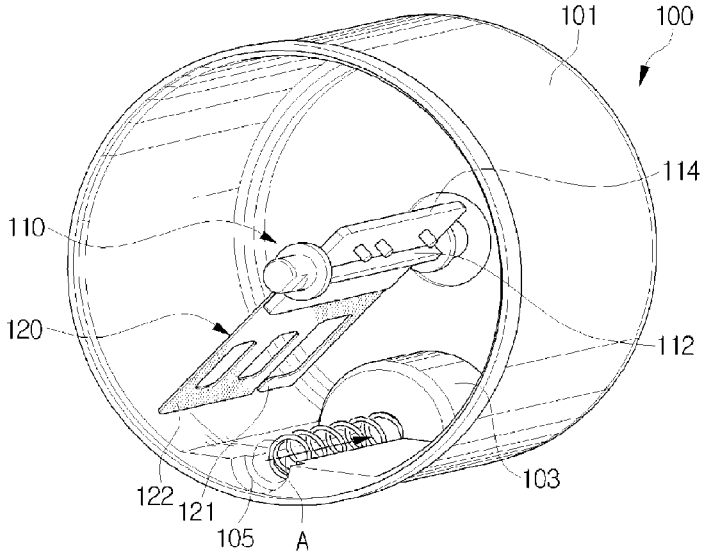
FIG. 1 is a perspective view of a toner supplying unit.

The present disclosure will now be described more fully with reference to the accompanying drawings in which exemplary embodiments of the present disclosure are shown.

According to an aspect of the present disclosure, an electrophotographic toner includes a binder that contains a crystalline polyester resin and an amorphous polyester resin, a colorant and a releasing agent, wherein the areas and shapes of crystalline polyester resin domains and releasing agent domains in a total cross-section of toner satisfy the following inequalities (1)-(5), wherein the cross-section of toner is observed by transmission electron microscopy (TEM) after being stained with ruthenium tetraoxide ($RuO_4$):

$$0.5\leq DS(R)/DL(R)\leq 1.0 \quad (1)$$

$$0.1\leq DS(C)/DL(C)\leq 1.0 \quad (2)$$

$$0.4\leq R\kappa/R\leq 1.0 \quad (3)$$

$$0.2\leq C_\lambda/C\leq 1.0 \quad (4)$$

$$0.15\leq (R\kappa+C_\lambda)/T\leq 0.5 \quad (5)$$

wherein DS(R) and DL(R) denote the shortest and longest diameters, respectively, of the releasing agent domains; and DS(C) and DL(C) denote the shortest and longest diameters, respectively, of the crystalline polyester resin domains, and R, Rκ, C, Cλ and T denote the total area of the entire releasing agent domains, the total area of the releasing agent domains which satisfy the inequality (1), the total area of the entire crystalline polyester resin domains, the total area of the crystalline polyester resin domains which satisfy the inequality (2), and the total area of the entire cross-section of toner, respectively.

The thermal and physical characteristics of electrophotographic toner may be affected by the morphological structure of the crystalline polyester resin. These characteristics may be determined by controlling the aggregation/coalescence (A/C) processes. For example, if the crystalline polyester resin domain has a needle shape, this may contribute to the dielectric loss factor and thus, the electric charge density of toner may be decreased. The stability of toner may also be decreased since the flowability of toner may be lowered due to surface protrusions in the crystalline polyester resin domain. This may be attributed to the molecular structure of polyester resin that include hydrophilic functional groups, such as a carboxylic group, a hydroxyl group, or an ester group, which tends to absorb moisture. These hydrophilic functional groups may be used for implementing low-temperature fixing.

The miscibility of the toner components (the releasing agent, the amorphous resin and the crystalline resin) may also affect the size and shape of the distribution domains of the toner components. Factors that affect the miscibility include, but are not limited to, interfacial tension, solubility parameter, acid value, molecular weight, molecular weight distribution, and the like. For example, the releasing agent and the crystalline polyester resin may be partially miscible, the releasing agent and the amorphous polyester resin may be immiscible, or the amorphous polyester resin and the crystalline polyester resin may fall between these two categories. The amorphous polyester resin may also have an acid value that is larger than that of the crystalline polyester resin by a predetermined amount in order to provide a morphological core/shell structure of toner including less protrusions on the surface of the crystalline polyester resin domain.

As described herein, the binder of the electrophotographic toner includes a crystalline polyester resin and an amorphous polyester resin. The crystalline polyester resin may be used to improve the gloss, stability and low-temperature fixability of toner images. The crystalline polyester resin may show a sharp endothermic peak, and not a stepwise endothermic change, in a differential scanning calorimetry (DSC) curve. For example, the crystalline polyester resin may have a half endothermic peak width of 15° C. or less when measured at a temperature ramp rate of 10° C./min. By contrast, the amorphous polyester resin typically has a half endothermic peak width of greater than 15° C. or shows no sharp peak in a DSC curve. The crystalline polyester resin may have a melting point (Tm), for example, of 60° C. to 80° C., or 65° C. to 75° C. If the melting point of the crystalline polyester resin is within the range of 60° C. to 80° C., aggregating of toner particles may be prevented, and the low-temperature fixability and preservation characteristics of toner images may be improved. The melting temperature of the crystalline polyester resin may be measured from endothermic peak temperatures in the DSC curve.

The melting point of a crystalline polyester resin, which has no glass transition temperature, may be read in the DSC curve. Thus, when added to another resin, the crystalline polyester resin may lower the melting point of the resin to which it is added. In other words, when the crystalline polyester resin having a relatively low melting point is added to an amorphous polyester resin to prepare toner, the melting temperature of the toner may be lowered due to the relatively low melting point of the crystalline polyester resin. This is called a sharp melting effect of the crystalline polyester resin. As a result, toner may be fixed at low temperatures. Since the crystalline polyester resin does not exhibit a glass transition temperature, the glass transition temperature of the amorphous polyester resin to which the crystalline polyester resin is added is rarely changed. As a result, the durability or the long-term preservation characteristics of toner is rarely affected.

The crystalline polyester resin may be prepared by polymerization condensation, for example, a direct esterification reaction or an ester exchange reaction, of polymerizable/condensable monomers, such as aliphatic, alicyclic, and aromatic polyvalent carboxylic acids; alkylesters, polyvalent alcohols, and ester compounds thereof; or hydroxycarboxylic acids in an aqueous medium.

Examples of polyvalent carboxylic acids that may be used to obtain the crystalline polyester resin include, but are not limited to, oxalic acid, malonic acid, succinic acid, glutaric acid, adipic acid, pimelic acid, suberic acid, azela phosphoric acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, acid anhydrides, oxychlorides thereof, and the like.

Examples of polyvalent alcohols that may be used to obtain the crystalline polyester resin include, but are not limited to, ethyleneglycol, diethyleneglycol, triethyleneglycol, 1,2-propyleneglycol, 1,3-propyleneglycol, 1,4-butandiol, 1,4-butenediol, neopentylglycol, 1,5-pentaneglycol, 1,6-hexaneglycol, 1,4-cyclohexanediol, 1,4-cyclohexanedimethanol, dipropyleneglycol, polyethyleneglycol, polypropyleneglycol, and the like.

Examples of the crystalline polyester resin include, but are not limited to, a polyester resin obtained by reacting 1,9-nonanediol and 1,10-decanedicarboxylic acid, or cyclohexanediol and adipic acid; a polyester resin obtained by reacting 1,6-hexanediol and sebacic acid; a polyester resin obtained by reacting ethyleneglycol and sebacic acid; and a polyester resin obtained by reacting 1,4-butandiol and succinic acid, and the like. The number of carbons for the dicarboxylic acid may be in the range from 10 to 12, and the number of carbon for the diol may be in the range from 4 to 9. For example, the crystalline polyester resin may be an aliphatic crystalline polyester resin obtained by reacting a $C_{10}$-$C_{12}$ dicarboxylic acid and a $C_4$-$C_9$ diol. If the numbers of carbons for the dicarboxylic acid and the diol are within these ranges, the crystalline polyester resin may have a fusing temperature suitable for toner. Such aliphatic crystalline polyester resin has a higher linearity and thus, has a higher miscibility to the amorphous polyester resin.

The polyester resin may be prepared at a polymerization temperature of about 180° C. to about 230° C., in a reaction system under reduced pressure if required, while water or alcohol produced during condensation is removed. If the polymerizable monomer is undissolved or incompatible at the reaction temperature, a high-boiling point solvent may be used as an auxiliary dissolving agent to dissolve the polymerizable monomer. During the polymerization and condensation reaction, the auxiliary dissolving agent may be removed by distillation. If the polymerizable monomer has low compatibility in a copolymerization reaction, the polymerizable monomer may be condensed with an acid or alcohol that is to be added for polymerization condensation, prior to the polymerization and condensation with the main component.

Examples of a catalyst that may be used to prepare such the polyester resin include, but are not limited to, an alkali metal compound including sodium (Na), lithium (Li), and the like; an alkali earth metal compound including magnesium (Mg), calcium (Ca), and the like; a metal compound including zinc (Zn), manganese (Mn), antimony (Sb), titanium (Ti), tin (Sn), zirconium (Zr), germanium (Ge), and the like; a phosphorous acid compound; a phosphoric acid compound; an amine compound, and the like.

The crystalline polyester resin may have a weight average molecular weight (Mw) of, for example, about 10,000 to about 30,000, or about 14,000 to about 25,000, wherein the weight average molecular weight is measured as the weight average molecular weight of a tetrahydrofuran (THF)-soluble component of the crystalline polyester resin by gel permeation chromatography (GPC). If the weight average molecular weight of the crystalline polyester resin is in the range of about 10,000 to about 30,000, plasticization of the toner caused due to the compatibility with the amorphous resin or the releasing agent may be prevented, and the viscosity of the toner may not be increased when the toner is melted. As a result, the loss of images caused by a hot-offset, or reduction in gloss due to an increased surface roughness may be prevented.

Examples of polyvalent carboxylic acids that may be used to obtain the amorphous polyester resin include, but are not limited to, phthalic acid, isophthalic acid, terephthalic acid, tetrachlorophthalic acid, chlorophthalic acid, nitrophthalic acid, p-carboxyphenylacetic acid, p-phenylene-2-acetic acid, m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, and the like.

Examples of polyvalent carboxylic acids, excluding dicarboxylic acids, include, but are not limited to, trimellitic acid, pyromellitic acid, naphthalene tricarboxylic acid, naphthalene tetracarboxylic acid, pyrene tricarboxylic acid, pyrene tetracarboxylic acid, and the like. The carboxylic groups of these carboxylic acids may be derived from an acid anhydride, an oxychloride, or an ester. For example, terephthalic acid or a lower ester thereof, diphenylacetic acid, or cyclohexane dicarboxylic acid, among the polyvalent cyclic acids listed herein, may be used. A lower ester means an ester of a $C_1$-$C_8$ aliphatic alcohol.

Examples of polyvalent alcohols that may be used to obtain the amorphous polyester resin include, but are not limited to, aliphatic diols, such as ethyleneglycol, diethyleneglycol, triethyleneglycol, propyleneglycol, butandiol, hexanediol, neopentylglycol, glycerin, and the like; alicyclic diols, such as cyclohexanediol, cyclohexanedimethanol, hydrogenated bisphenol-A, and the like; aromatic diols, such as an ethyleneoxide adduct of bisphenol-A or a propyleneoxide adduct of bisphenol-A, and the like. These polyvalent alcohols may be used alone or in combination. For example, aromatic diols or alicyclic diols, among the polyvalent alcohols listed herein, may be used. Aromatic diols may also be used. In order to ensure excellent fixability, trivalent or higher polyvalent alcohols, such as glycerin, trimethylolpropane, or pentaerythritol, may be used together with diols to provide a cross-linked or branched structure.

The amorphous polyester resin may be prepared by condensing a polyvalent alcohol and a polyvalent carboxylic acid according to a general method. For example, the polyvalent alcohol and the polyvalent carboxylic acid are mixed together, with a catalyst if necessary, in a reaction vessel equipped with a thermometer, a stirrer, and reflux condenser, and heated at 150-250° C. in an inert gas (for example, nitrogen gas) until the mixture reaches a predetermined acid value, while residual low-molecular weight compounds are continuously removed from the reaction system. The reaction product may be cooled to obtain the final reaction product.

Examples of catalysts that may be used to synthesize the amorphous polyester resin include, but are not limited to, antimony-based catalysts, tin-based catalysts, titanium-based catalysts, aluminum-based catalysts, and the like. For example, catalysts for the esterification of organic metals, such as dibutyl tin dilaurate or dibutyl tin oxide, or metal alkoxides such as tetrabutyl titanate may be used. In an environmental or safety aspect, titanium-based catalysts or aluminum-based catalysts may be used. The amount of the catalyst may be in the range of about 0.01 to about 1.00 wt % based on the total weight of the reactants.

The amorphous polyester resin may have a weight average molecular weight (Mw) of, for example, about 5,000 to about 60,000, or about 7,000 to about 50,000, a number average molecular weight (Mn) of about 2,000 to about 10,000, and a molecular weight distribution (Mw/Mn) of about 1.5 to about 10, wherein the weight average molecular weight is measured as the weight average molecular weight of a tetrahydrofuran (THF)-soluble component of the amorphous polymer resin by GPC. If the weight average molecular weight and the number average molecular weight of the amorphous polyester resin are within these ranges, the low-temperature fixability and anti-hot-offset characteristics of toner may be improved. The intensity of the amorphous polyester resin may not be reduced and thus, the strengths of images fixed on a print medium may also be increased. The preservation characteristics, such as anti-blocking characteristics, of toner may also be improved since a decrease in the glass transition temperature of toner may be prevented.

The binder may include, for example, 70 wt % or greater, about 70 wt % to about 99 wt %, or about 80 wt % to about 97 wt % of the amorphous polyester resin based on the total weight of the binder of the core layer, and may include about 30 wt % or less, about 1 wt % to about 30 wt %, or about 3 wt % to about 20 wt % of the crystalline polyester resin based on the total weight of the binder. If the amount of the amorphous polyester resin in the binder is 70 wt % or greater and the amount of the crystalline polyester resin is 30 wt % or less based on the total weight of the binder, the strength of toner may be maintained, and the toner may be fixed at low temperatures. Image quality defects caused by the internal contamination of the imaging system may also be prevented, and the thermal storage characteristics and the charging characteristics of toner may be improved.

Among colorants used to prepare the colorant dispersion, a black colorant such as carbon black or aniline black, may be used. For color toner, at least one colorant selected from a cyan colorant, a magenta colorant, and a yellow colorant may be used. These colorants may be used alone or in combination, and may be selected in consideration of color, chromaticity, brightness, weather resistance, or dispersibility in toner.

Examples of the cyan colorant include, but are not limited to, copper phthalocyanine compounds and derivatives thereof, anthraquinone compounds, base dye lake compounds, and the like. Examples of the cyan colorant include, but are not limited to, C.I. pigment blues 1, 7, 15, 15:1, 15:2, 15:3, 15:4, 60, 62, 66, and the like.

Examples of the magenta colorant include, but are not limited to, condensed nitrogen compounds, anthraquine compounds, quinacridone compounds, base dye lake compounds, naphthol compounds, benzoimidazole compounds, thioindigo compounds, perylene compounds, and the like. Examples of the magenta colorant include, but are not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, 254, and the like.

The yellow colorant may be a condensed nitrogen compound including but not limited to an isoindolinone compound, an anthraquinone compound, an azo metal complex, an alkyl imide compound, and the like. Examples of the yellow colorant include, but are not limited to, C.I. pigment yellows 12, 13, 14, 17, 62, 74, 83, 93, 94, 95, 109, 110, 111, 128, 129, 147, 168, 180, and the like.

The amount of the colorant may be in the range of about 0.5 to about 15 parts by weight, about 1 to about 12 parts by weight, or about 2 to about 10 parts by weight, based on 100 parts by weight of toner. When the amount of the colorant is greater than or equal to 0.5 parts by weight based on 100 parts by weight of toner, a sufficient coloring effect may be obtained. When the amount of the colorant is less than or equal to about 15 parts by weight based on 100 parts by weight of toner, a sufficient electrification amount may be obtained without an increase in toner manufacturing costs.

The emulsifier used to prepare the colorant dispersion may be any emulsifier known to one of ordinary skill in the art. For example, the emulsifier may be an anionic reactive emulsifier, a non-ionic reactive emulsifier, or a mixture thereof. The anionic reactive emulsifier may be HS-10 (Dai-lchi Kogyo Seiyaku Co., Ltd.) or DOWFAX 2A1 (The Dow Chemical Company). The non-ionic reactive emulsifier may be RN-10 (Dai-lchi Kogyo Seiyaku Co., Ltd.).

The releasing agent enables toner to fix to the final-image receptor at a low fixing temperature and to have excellent final image durability and resistance to abrasion. Thus, characteristics of toner are very dependent on the type and amount of the releasing agent. The releasing agent may include, but are not limited to, polyethylene-based wax, polypropylene-based wax, silicon wax, paraffin-based, ester-based wax, carnauba wax, metallocene wax, and the like. The releasing agent may have a melting point of, for example, about 50° C. to about 150° C. The releasing agent may be physically attached to toner particles, but is not covalently bonded with toner particles and thus, enables toner to be fixed to the final-image receptor at a low temperature and thus, provides a final image that has excellent durability and resistance to abrasion.

The amount of the releasing agent may be in the range of about 1 to about 20 parts by weight, about 2 to about 16 parts by weight, or about 3 to about 12 parts by weight, based on 100 parts by weight of toner. When the amount of the releasing agent is greater than or equal to about 1 part by weight based on 100 parts by weight of toner, toner may have good low-temperature fixing characteristics and a sufficiently wide fixing temperature range. When the amount of the releasing agent is less than or equal to about 20 parts by weight based on 100 parts by weight of toner, toner may have improved storage characteristics and may be prepared at a lower manufacturing cost.

The releasing agent may be an ester group-containing wax. Examples of the ester group-containing wax include, but are not limited to, a mixture of an ester-based wax and a non-ester based wax; an ester group-containing wax prepared by adding an ester group to a non-ester based wax, and the like. Since an ester group has high affinity with respect to the binder component of the electrophotographic toner, the wax may be uniformly distributed among toner particles and thus, may effectively function. The non-ester based wax has a releasing effect on the binder and thus, may suppress excessive plasticizing reactions, which occur when an ester-based wax is exclusively used. Therefore, toner may retain satisfactory development characteristics for a long period of time. Examples of the ester-based waxes include, but are not limited to, esters of monovalent to pentavalent alcohols and $C_{15}$-$C_{30}$ fatty acids, and the like. Also, if the alcohol component constituting the ester is a monovalent alcohol, it may include 10 to 30 carbon atoms. If an alcohol component constituting the ester is a polyvalent alcohol, it may include 3 to 10 carbon atoms.

The non-ester based wax may be polymethylene-based wax or paraffin-based wax. Examples of the ester group-containing wax include, but are not limited to, a mixture of a paraffin-based wax and an ester-based wax; an ester group-containing paraffin-based wax, and the like. Examples of the ester group-containing wax may also include, but are not limited to, P-280, P-318, and P-319 (available from Chukyo Yushi Co., Ltd. of Nagoya, Japan), and the like.

If the releasing agent is a mixture of a paraffin-based wax and an ester-based wax, the amount of the ester-based wax in the releasing agent may be, for example, in the range of about 1 to about 35 weight %, about 3 to about 33 weight %, or about 5 to about 30 weight %, based on the total weight of the paraffin-based wax and the ester-based wax. When the amount of the ester-based wax is greater than or equal to about 1 wt % based on the total weight of the releasing agent, the compatibility of the ester-based wax with the binder may be sufficiently maintained. When the amount of the ester-based wax is less than or equal to about 35 weight % based on the total weight of the releasing agent, toner may have appropriate plasticizing characteristics and thus, may retain satisfactory development characteristics for a long period of time. Anti-offset characteristics at high temperatures and gloss may also be improved.

The difference (SPB-SPR) between the solubility parameter of the binder (SPB) and the solubility parameter of the releasing agent (SPR) may be, for example, about 2 or greater, about 3 to about 6, or about 3.5 to about 5. When the difference (SPB-SPR) between the solubility parameter of the binder (SPB) and the solubility parameter of the releasing agent (SPR) is about 2 or greater, the compatibility of the binder resin and the releasing agent may appropriately retain and thus, crystallization of the binder may be suppressed. As a result, the toner may have satisfactory charging characteristics and low-temperature characteristics.

According to an aspect of the present disclosure, the electrophotographic toner may further include various additives, such as inorganic particles, organic particles, and a charge controller.

The inorganic particles may be used to improve the flowability of toner. Examples of the inorganic particles include, but are not limited to, silica, alumina, titanium oxide, barium titanate, magnesium titanate, calcium titanate, strontium titanate, zinc oxide, silica, clay, mica, wollastonite, diatomite, cerium chloride, bengala, chrome oxide, cerium oxide, antimony oxide, magnesium oxide, zirconium oxide, silicon carbide and silicon nitride in particle form. For example, silica particles, among the inorganic particles listed herein, may be used. Hydrogenated silica particles may also be used. The inorganic particles may have a number average particle diameter of, for example, about 1 to about 1000 nm. The amount of the inorganic particles may be in the range of about 0.01 to about 20 parts by weight based on 100 parts by weight of toner.

The organic particles may be used in order to improve the cleaning or transferring characteristics or the charging characteristics of toner. Examples of the organic particles include, but are not limited to, polystyrene, polymethylmethacrylate, polyfluorovinyldidene, a polystyrene-acryl copolymer in particle form, and the like.

The charge controller may be used is to improve the charging characteristics of toner. Examples of the charge controller include, but are not limited to, a metal salt of salicylic acid, a metal-containing azo compound, nigrosine, a quaternary ammonium salt, and the like.

The electrophotographic toner may include a binder that contains a crystalline polyester resin and an amorphous polyester resin, a colorant and a releasing agent stained with ruthenium tetraoxide ($RuO_4$). The toner may be observed by TEM to analyze the areas and shapes of crystalline polyester resin domains and releasing agent domains in a total cross-section of the electrophotographic toner.

Staining of the electrophotographic toner with ruthenium tetraoxide ($RuO_4$) may be performed using a general method. The cross-section of the electrophotographic toner may be observed by the following method. After being stained with ruthenium tetraoxide ($RuO_4$), the electrophotographic toner is molded using epoxy resin and sliced to a cross-section by using a ultra-microtome. The cross-section of the electrophotographic toner may be observed by TEM in order to identify the crystalline polyester resin domains and the releasing agent domains.

The shapes of the crystalline polyester resin domains and the releasing agent domains in the cross-section of the electrophotographic toner satisfy the following inequalities (1)-(2):

$$0.5 \leq DS(R)/DL(R) \leq 1.0 \quad (1)$$

$$0.1 \leq DS(C)/DL(C) \leq 1.0 \quad (2)$$

wherein DS(R) and DL(R) denote the shortest and longest diameters of the releasing agent domains, respectively, and DS(C) and DL(C) denote the shortest and longest diameters of the crystalline polyester resin domains, respectively.

The ratio of DS(R)/DL(R) may be, for example, about 0.5 to about 1.0, about 0.55 to about 0.9, or about 0.6 to about 0.8. When the ratio of DS(R)/DL(R) is within the range of about 0.5 to about 1.0, growing of the releasing agent domain in a needle shape may be prevented during cooling, not to be exposed to the surface of the electrophotographic toner. Thus, toner particles are unlikely to agglomerate, thereby improving the flowability, storage characteristics, and storage stability of the electrophotographic toner.

The ratio of DS(C)/DL(C) may be, for example in the range of about 0.1 to about 1.0, about 0.2 to about 0.9, or about 0.3 to about 0.8. When the ratio of DS(C)/DL(C) is less than about 0.1, the crystalline polyester resin domain may have a needle-like cross-section since its longest diameter is considerably greater than the shortest one, and may have a needle-like crystalline structure. This crystalline structure may be exposed to the surface of the toner and form a charge flow path during charging of the toner, thereby causing a dielectric loss. If the ratio of DS(R)/DL(R) is within the range of about 0.5 to about 1.0, then the growing of the polyester resin domains and needle-like crystals may be prevented during cooling. As a result, the toner may have improved charging stability, flowability, low-temperature fixing characteristics, and storage stability.

The area of the crystalline polyester resin domains in the cross-section of the toner may satisfy the inequalities (3)-(5) below:

$$0.4 \leq R\kappa/R \leq 1.0 \quad (3)$$

$$0.2 \leq C_\lambda/C \leq 1.0 \quad (4)$$

$$0.15 \leq (R\kappa+C_\lambda)/T \leq 0.5 \quad (5)$$

wherein R, Rκ, C, $C_\lambda$ and T denote the total area of the entire releasing agent domains, the total area of the releasing agent domains which satisfy the inequality (1), the total area of the entire crystalline polyester resin domains, the total area of the crystalline polyester resin domains which satisfy the inequality (2), and the total area of the entire cross-section of toner, respectively.

The ratio of Rκ/R may be, for example, in the range of about 0.4 to about 1.0, about 0.45 to about 0.9, or about 0.5 to about 0.8. When the ratio of Rκ/R is 0.4 or greater, the proportion of releasing agent domains having a needle-like shape may be low, and the releasing agent domains may likely not be exposed to the surface of toner. Thus, the long-term storage characteristics of toner may be improved, and toner particles may be prevented from agglomerating, thereby improving the stability and flowability of toner. The preparation of toner may also be facilitated.

The ratio of $C_\lambda/C$ may be, for example, in the range of about 0.2 to about 1.0, about 0.25 to about 0.9, or about 0.3 to about 0.8. When the ratio of $C_\lambda/C$ is 0.2 or greater, a proportion of crystalline polyester resin having a needle-like shape may be low, and the charging characteristics of toner may not deteriorate. As a result, less amount of an external additive may be used to improve charging characteristics, thereby improving fixability, and in particular, low-temperature fixability of toner.

The ratio of $(R\kappa+C_\lambda)/T$ may be, for example, in the range of about 0.15 to about 0.5, about 0.18 to about 0.45, or about 0.2 to about 0.4. When the ratio of $(R\kappa+C_\lambda)/T$ is in the range of about 0.15 to about 0.5, the fixability, storage characteristics and flowability of toner may be improved since the amorphous polyester resin occupies more than half of the binder, which includes the amorphous polyester resin and the crystalline polyester resin.

The difference between an amorphous polyester resin's acid value (AV) and the crystalline polyester resin's AV may satisfy the following inequality (6):

$$2 \leq \text{amorphous polyester resin's AV} - \text{crystalline polyester resin's AV} \leq 15 \quad (6).$$

The amorphous polyester resin's AV and the crystalline polyester resin's AV means the number of milligrams (mg) of KOH required to neutralize 1 g of each of the amorphous polyester resin and the amorphous polyester resin. The difference between the amorphous polyester resin's AV and the crystalline polyester resin's AV may be, for example, in the range of about 2 to about 15, about 2.5 to about 13, or about 3 to about 12. When the difference between the amorphous polyester resin's AV and the crystalline polyester resin's AV is within the range of about 2 to about 15, since the amorphous polyester resin's AV is high enough to make the surface of toner hydrophilic and slippery, agglomeration of toner may be prevented. The crystalline polyester resin may be liable to be encapsulated by the amorphous polyester resin in toner, thereby improving the gloss, low-temperature fixability and preservation characteristics of toner.

The electrophotographic toner may have a volume average particle diameter in the range of, for example, about 3 to about 9 μm, about 4 to about 8 μm, or about 4.5 to about 8.5 μm. In general, the smaller toner particle size, the higher the resolution and the higher the quality of an image may be achieved. However, when transfer speed and cleansing force are taken into consideration, small toner particles may not be appropriate for all applications.

The volume average particle diameter of toner may be measured by electrical impedance analysis. When the volume average particle diameter of toner is greater than or equal to about 3 μm, it may be easier to clean the photoreceptor, mass-production yield may be improved, and no harmful effects on the human body are caused due to scattering. On the other hand, when the volume average particle diameter of toner is equal to or less than about 9.5 μm, this may lead to uniform charging, may improve fixability of toner, and may make it easier to regulate the toner layer with a doctor blade.

The electrophotographic toner may have an average circularity in the range of, for example, about 0.945 to about 0.985, about 0.95 to about 0.98, or about 0.965 to about 0.975. The circularity of toner may be measured using a flow particle image analyzer (e.g., the FPIA-3000 particle analyzer available from SYSMEX Corporation of Kobe, Japan), and using the following equation:

$$\text{Circularity}=2\times(\pi\times\text{area})^{0.5}/\text{circumference}$$

The circularity may be in the range of 0 to 1, and as the circularity approaches 1, toner particle shape becomes more circular. When the electrophotographic toner has an average circularity of 0.945 or greater, an image developed on the transfer medium may have an appropriate thickness and thus, toner consumption may be reduced. Voids between toner particles are not too large and thus, the image developed on the transfer medium may have a sufficient coating rate. On the other hand, when the electrophotographic toner has an average circularity of 0.985 or less, an excessive amount of toner being supplied onto the development sleeve may be prevented, making it possible to reduce the contamination of the development sleeve that may result from the non-uniform coating of toner thereon.

The toner particle distribution coefficients may include a volume average particle size distribution coefficient (GSDv) or a number average particle size distribution coefficient (GSDp), which may be measured as follows. First, the toner particle size distribution is obtained from toner particle diameters measured using a particle sizing and counting analyzer, for example, the Multisizer III available from Beckman Coulter, Inc. of Fullerton, Calif., U.S.A. Next, the toner particle diameter distribution may be divided into predetermined particle diameter ranges (channels). Finally, with respect to the respective particle diameter ranges (channels), the cumulative volume distribution of toner particles and the cumulative number distribution of toner particles are measured, wherein, in each of the cumulative volume and number distributions, the particle size in each distribution is increased in the direction from left to right. A cumulative particle diameter at 16% of the respective cumulative distributions is defined as the volume average particle diameter D16v and the number average particle diameter D16p; a cumulative particle diameter at 50% of the respective cumulative distributions is defined as the volume average particle diameter D50v and the number average particle diameter D50p; and a cumulative particle diameter at 84% of the respective cumulative distributions is defined as the volume average particle diameter D84v and the number average particle diameter D84p.

The GSDv and the GSDp may be obtained using the relations that the GSDv is defined as $(D84v/D16v)^{0.5}$, and the GSDp is defined as $(D84p/D16p)^{0.5}$. The GSDv may be, for example, about 1.25 or less, or in the range of about 1.15 to about 1.20. The GSDp may be, for example, about 1.30 or less, in the range of about 1.15 to about 1.30, or in the range of about 1.20 to about 1.25. When each of the GSDv and GSDp is within these ranges, the electrophotographic toner may have a uniform particle diameter.

With regard to the particle diameter distribution of toner measured by the Coulter method, the electrophotographic toner may contain less than 3 wt % of fine particles having a volume average particle diameter of less than 3 μm, and less than 0.5 wt % of coarse particles having a volume average particle diameter of 16 μm or greater. In other words, when a proportion of too fine particles and too coarse particles is appropriately controlled for the electrophotographic toner, the toner may be supplied from the developing roller to the photoreceptor by applying an appropriate amount of charges, so that the developing properties of toner and the resolution of the printed image may be improved.

The electrophotographic toner may further include iron (Fe) and silicon (Si), wherein the [Si]/[Fe] ratio is in the range of about $5.0\times10^{4}$ to about $5.0\times10^{-2}$, wherein [Fe] and [Si] denote the intensities of Fe and Si, respectively, as measured by X-ray fluorescence spectrometry.

As used herein, [Fe] corresponds to the amount of Fe contained in an agglomerating agent that is used to agglomerate the binder, the colorant and the releasing agent when toner is prepared. Thus, [Fe] may affect the agglomeration properties, the particle distribution and the particle size of agglomerated toner. The agglomerated toner may be a precursor for preparing a final toner.

As used herein, [Si] corresponds to the amount of Si contained in an agglomerating agent that is used to prepare toner, or the amount of Si contained in silica particles that are externally added to secure the flowability of toner. Thus, [Si] may affect the agglomeration properties, the particle distribution and the particle size of agglomerated toner, as [Fe] does, and may also affect the flowability of toner.

The [Si]/[Fe] ratio may be, for example, in the range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$. When the [Si]/[Fe] ratio is within the range of about $5.0\times10^{-4}$ to about $5.0\times10^{-2}$, the amount of silica, used as an external additive, may be appropriately controlled, thereby improving the flowability of toner and preventing contamination of the inside of the printer.

In the electrophotographic toner, a main endothermic peak may appear at a temperature of, for example, about 50 to about 150° C., about 60 to about 140° C., or about 70 to about 130° C., as measured by scanning electron microscopy (DSC) according to ASTM D-3418-8. When the temperature at which the main endothermic peak appears is within the range of about 50° C. to about 80° C., the preservation characteristics of toner or toner images after fusing may be improved, and the toner may have satisfactory low-temperature fixability.

Solubility parameters (SP) of the binder and the releasing agent may be calculated using by Fedors' equation below (Polym. Eng. Sci., Vol. 14, p. 147 (1974)):

$$SP=(\Delta Ev/V)^{1/2}$$

wherein ΔEv denotes evaporation energy (cal/mol), and V denotes molar volume ($cm^3$/mol).

The SPs may be calculated from the composition of used monomers by using the following equation:

$$SP=(\Delta Ev/V)^{1/2}=(\Sigma\Delta ei/\Sigma vi)^{1/2}$$

wherein ΔEv denotes an evaporation energy (cal/mol), V denotes the molar volume ($cm^3$/mol), Δei denotes the evaporation energy of each atom or atom group, and Δvi denotes the molar volume of each atom or atom group. The measurement unit $(cal/cm^3)^{1/2}$ may be converted to $(J/cm^3)^{1/2}$ by multiplying by 2.046.

According to another aspect, the present disclosure provides methods for preparing the electrophotographic toner described herein, including a) mixing primary binder particles, a colorant dispersion, and a releasing agent dispersion to provide a mixed solution; b) adding an agglomerating agent to the mixed solution to provide core-layer particles; and c) coating the core-layer particles with shell-layer particles containing secondary binder particles to provide toner particles, wherein the secondary binder particles are prepared by polymerizing at least one polymerizable monomer.

The amounts of the amorphous polyester resin and the crystalline polyester resin that constitute the primary binder particles, types and preparation methods of polyvalent carboxylic acid and polyvalent alcohol used as source materials are the same as those described herein.

The primary binder particles, which are prepared using the amorphous and crystalline polyester resin, may be prepared through an inverse phase emulsification from a dispersion prepared by dispersing a polyester resin prepared through condensation polymerization, an alkali compound, and, optionally, a surfactant, in water. In particular, the primary binder particles may be prepared through three processes, i.e., dissolution, emulsification, and desolvation. In the dissolution process, a polyester resin solution is prepared by dissolving a polyester resin in an organic solvent. Any organic solvent that can dissolve the polyester resin may be used without limitation. In the emulsification process, a basic compound and water are added to the polyester resin solution prepared in the dissolution process, and are subjected to a phase inversion emulsification. Optionally, a surfactant may further be added. Herein, the amount of the basic compound may be determined based an equivalent ratio to the amount of the carboxylic acid calculated from the acid value of the polyester resin. The resulting primary binder particles may have a volume average diameter of about 1 μm or less, in the range of about 100 to about 300 nm, or in the range of about 150 to about 250 nm.

The primary binder particles may further include a charge control agent. The charge control agent may be a negatively charged charge control agent or a positively charged charge control agent. Examples of the negatively charged charge control agent include, but are not limited to, organic metal complexes such as a chromium containing azo complex and a mono-azo metal complex, or chelate compounds; metal-containing salicylic acid compounds wherein the metal may be chromium, iron, or zinc; and organic metal complexes such as aromatic hydroxycarboxylic acids or aromatic dicarboxylic acid. The positively charged charge control agent may be a modified product, such as nigrosine or a fatty acid metal salt thereof; or an onium salt including a quaternary ammonium salt such as tributylammonium 1-hydroxy-4-naphthosulfonate or tetrabutylammonium tetrafluoroborate. The charge control agents may be used alone or in combination. The charge control agent may operate to stably support toner on a development roller with an electrostatic force. Thus, by using the charge control agent, stable and high-speed charging may be ensured.

The primary binder particles obtained as described herein may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer. Among colorants used to prepare the colorant dispersion, the black colorant may be carbon black or aniline black. For color toner, at least one colorant selected from cyan colorant, magenta colorant, and yellow colorant may be further used in addition to the black colorant.

The emulsifier used to prepare the colorant dispersion may be any emulsifier known in the art. For example, the emulsifier may be an anionic reactive emulsifier, a non-ionic reactive emulsifier, or a mixture thereof. The anionic reactive emulsifier may be HS-10 (Dai-lchi Kogyo Seiyaku Co., Ltd.) or DOWFAX 2A1 (The Dow Chemical Company); and the non-ionic reactive emulsifier may be RN-10 (Dai-lchi Kogyo Seiyaku Co., Ltd.).

The releasing agent dispersion used in preparing the toner may include a releasing agent, water, or an emulsifier. The releasing agent enables toner to be fixed to the final-image receptor at a low fixing temperature and to have excellent final image durability and resistance to abrasion. Thus, the characteristics of toner are very dependent on the type and amount of the releasing agent. A detailed description of the releasing agent is provided herein.

The primary binder particles, the colorant dispersion and the releasing agent dispersion prepared as described herein are mixed to obtain a solution. An agglomerating agent is added to the mixed solution to prepare the core-layer particles. In particular, after the primary binder particles, the colorant dispersion, and the releasing agent dispersion are mixed to obtain a mixed solution, an agglomerating agent is added at a pH of about 0.1 to about 4.0, and subjected to agglomeration at a temperature of about 25 to about 70° C., for example, about 35 to about 60° C., which is lower than the glass transition temperature (Tg) of the primary binder particles, and fusing at a temperature of about 85 to about 100° C. (a temperature that is about 30 to 50° C. higher than the Tg), thereby forming the core-layer particles having a particle size of about 4 to about 7 μm. Alternatively, in preparing the core-layer particles, fine toner having a particle size of about 0.5 to about 3 μm may first be prepared, followed by agglomeration to finally obtain the core-layer particles having a particle size of about 4 to about 7 μm.

After the formation of the core-layer particles, the core-layer particles are coated with shell-layer particles comprising secondary binder particles to thereby produce toner particles, wherein the secondary binder particles are prepared by polymerizing at least one polymerizable monomer. In particular, in the method of preparing the electrophotographic toner, the coating of the core-layer particles with the shell-layer particles to provide toner particles may include: a) agglomerating the core-layer particles and the shell-layer particles at a temperature at which the core-layer particles and the shell-layer particles have a shear storage modulus (G') of about $1.0\times10^8$ to about $1.0\times10^9$ Pa; b) stopping the agglomerating when the average particle diameter of the particles obtained in operation a) reaches about 70% to about 100% of the average particle diameter of the final toner particles; and c) fusing and coalescing the particles obtained in operation b) at a temperature at which the particles obtained in operation b) have a shear storage modulus (G') of about $1.0\times10^4$ to about $1.0\times10^9$ Pa.

The agglomerating of the core-layer particles and the shell-layer particles is a physical agglomeration process. This process may be performed at a temperature at which the core-layer particles and the shell-layer particles have a shear storage modulus (G') of about $1.0\times10^8$ to about $1.0\times10^9$ Pa in order to prevent the core-layer particles and the shell-layer particles from being fused earlier than expected. This may be advantageous in controlling the particle size distribution of toner.

The fusing and coalescing of the particles obtained in operation b) may be performed by heating the particles at a temperature at which the particles obtained in operation b) have a shear storage modulus (G') of about $1.0\times10^4$ to about $1.0\times10^9$ Pa, i.e., a temperature about 10° C. to about 30° C. higher than or equal to the melting point of the particles obtained in operation b).

After the secondary binder particles, which constitute shell-layer particles, are added to the core-layer particles, the pH of the system is adjusted to about 6 to about 9 and left until a particle size of the mixture is maintained constant for a predetermined period of time. The temperature is raised to about 90 to about 98° C., and the pH is lowered to about 5 to about 6 in order to coalesce the mixture into the toner particles.

A Si- and Fe-containing metal salt may be used as the agglomerating agent. When such a metal salt containing Si and Fe is used, primary agglomerated toner may have a larger particle size due to enhanced ionic strength and inter-particle collisions. The Si and Fe-containing metal salt may include polysilicate iron. Examples of the Si and Fe-containing metal include, but are not limited to, PSI-025, PSI-050, PSI-075, PSI-100, PSI-200, and PSI-300, which are products manufactured by Suido Kiko Co. Table 1 shows the physical properties and compositions of PSI-025, PSI-050, PSI-075, PSI-100, PSI-200, and PSI-300.

TABLE 1

| Type | | PSI-025 | PSI-050 | PSI-085 | PSI-100 | PSI-200 | PSI-300 |
|---|---|---|---|---|---|---|---|
| Si/Fe mole ratio | | 0.25 | 0.5 | 0.85 | 1 | 2 | 3 |
| Conc. of main component | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or greater | | | | | |
| Average molecular weight (Dalton) | | 500,000 | | | | | |
| Appearance | | transparent, yellowish brown liquid | | | | | |

The amount of the agglomerating agent may be in the range of about 0.1 to about 10 parts by weight, about 0.5 to about 8 parts by weight, or about 1 to about 6 parts by weight, based on 100 parts by weight of the primary binder particles. When the amount of the agglomerating agent is greater than or equal to about 0.1 parts by weight, agglomeration efficiency may increase. When the amount of the agglomerating agent is less than or equal about 10 parts by weight, the charging properties of toner may not be degraded, and the particle size distribution may become more uniform.

The primary latex particles may consist exclusively of a polyester resin or may include a mixture (hybrid) of a polyester resin and a polymer synthesized by polymerizing at least one polymerizable monomer.

The primary binder particles may be prepared from a mixture of the polyester resin and a polymer prepared by polymerizing at least one polymerizable monomer. In this case, examples of the at least one polymerizable monomer used herein may include, but are not limited to, at least one polymerizable monomer selected from styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinylethers such as vinylmethylether or vinylethylether; vinylketones such as vinylmethylketone or methylisoprophenylketone; and a nitrogen-containing vinyl compound such as 2-vinylpyridine, 4-vinylpyridine, N-vinylpyrrolidone, and the like.

For an efficient polymerization of the at least one polymerizable monomer, a polymerization initiator and a chain transfer agent may be further used.

Examples of the polymerization initiator include, but are not limited to, persulfates such as potassium persulfate, ammonium persulfate, and the like; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxyl-methyl)-2-hydroxy ethylpropioamide, 2,2'-azobis(2,4-dimethylvaleronitrile), 2,2'-azobisisobutyronitrile, 1,1'-azobis(1-cyclohexancarbonitrile), and the like; and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, di-t-butylperoxyisophthalate, and the like. Oxidation-reduction initiators prepared by combining these polymerization initiators and reductants may also be used as the polymerization initiator.

A chain transfer agent refers to a material that changes the type of a chain carrier during a chain reaction, or may include a material capable of weakening the activity of a new chain to be less than the activity of existing chains. As a result of using a chain transfer agent, the degree of polymerization of polymerizable monomers may be reduced, and reaction for a novel chain may be initiated. Also, as a result of using a chain transfer agent, the molecular weight distributions of toner may be controlled.

Examples of the chain transfer agent include, but are not limited to, sulfur-containing compounds such as dodecanethiol, thioglycolic acid, thioacetic acid, and mercaptoethanol; phosphorous acid compounds such as phosphorous acid and sodium phosphorous acid; hypophosphorous acid compounds such as hypophosphorous acid and sodium hypophosphorous acid; and alcohols such as methyl alcohol, ethyl alcohol, isopropyl alcohol, n-butyl alcohol, and the like. The amount of the chain transfer agent may be in the range of about 0.1 to about 5 parts by weight, about 0.2 to about 3 parts by weight, or about 0.5 to about 2.0 parts by weight, based on 100 parts by weight of the at least one polymerizable monomer. When the amount of the chain transfer agent is within these ranges, the molecular weight of the toner may be appropriately controlled and thus, the toner may have improved agglomeration efficiency and fixing characteristics.

The resulting secondary binder particles may have a volume average diameter, of about 1 μm or less, or a volume average diameter in the range of about 100 to about 300 nm. The secondary binder particles may also include a releasing agent, which may be incorporated into the secondary binder particles in the polymerization process.

The prepared toner particles may be additionally coated with tertiary binder particles. The tertiary binder particles may also be prepared from polyester resin alone or a mixture (hybrid) of polyester resin and a polymer prepared by polymerizing at least one polymerizable monomer.

By forming one or more shell layers from the secondary binder particles or tertiary binder particles, toner may have higher durability and excellent preservation characteristics during shipping and handling. The polymerization inhibitor may be further added to prevent formation of new binder particles. The mixed monomer solution may be coated on toner in starved-feeding conditions to ensure coating quality.

The obtained toner particles having one or two shell layers may be filtered to separate toner particles, and dried. An external additive is added to the dried toner particles, and the amount of charges is controlled, thereby obtaining the final dry toner. The external additive may include silica or $TiO_2$. The amount of the external additive may be in the range of about 1.5 to about 7 parts by weight, or about 2 to about 5 parts by weight, based on 100 parts by weight of toner to which the external additive is not added. When the amount of the external additive is greater than or equal to about 1.5 parts by weight based on 100 parts by weight of toner to which the external additive is not added, caking that occurs as toner particles adhere to each other due to an inter-particle agglomeration force is prevented, and the amount of charge applied may be stable. When the amount of the external additive is less than or equal to about 7 parts by weight based on 100 parts by weight of toner to which the external additive is not added, the external additive may not contaminate the roller.

According to another aspect, the present disclosure provides imaging methods, including: attaching toner to a surface of an image carrier (for example, a photoreceptor) on which an electrostatic latent image is formed so as to form a visualized image; and transferring the visualized image onto a transfer medium, wherein the electrophotographic toner described herein, including a binder, a colorant and a releasing agent, is used.

A representative electrophotographic imaging process includes a series of imaging processes on a receptor, including charging, exposure-to-light, developing, transferring, fixing, cleaning, and erasing processes.

In the charging process, a surface of the image carrier is charged with negative or positive charges, whichever is desired, by a corona or a charge roller. In the exposure-to-light process, the charged surface of the image carrier is selectively discharged using a laser scanner or an array of diodes in an image-wise manner in order to form a latent image corresponding to the final visual image to be formed on a final-image receptor, such as, for example, a sheet of paper. Electromagnetic radiation that may be referred to as "light radiation" include, but is not limited to, infrared radiation, visible light radiation, and ultraviolet radiation.

In the developing process, toner particles having an appropriate polarity contact the latent image on the image carrier. To this end, an electrically-biased developer having the same potential polarity as the polarity of toner particles may be used. Toner particles move to the image carrier, selectively adhere to the latent image due to an electrostatic force and thus, forms a toner image on the image carrier.

In the transferring process, toner image may be transferred from the image carrier to the image receptor where the final image is formed. In some cases, an intermediate transferring element may be used to aid the transfer of toner image from the image carrier to the final-image receptor.

In the fixing process, the toner image on the final-image receptor may be heated to soften or melt toner particles, thereby fixing the toner image to the final-image receptor. An alternative fixing method may involve fixing the toner image to the final-image receptor under high pressure with or without the application of heat.

In the cleaning process, residual toner remaining on the image carrier is removed.

Finally, in the charge-erasing process, the charges on the image carrier are exposed to light having a specific wavelength and thus, are uniformly erased resulting in a substantially lower amount of charges on the image carrier. Therefore, the residue of the latent image may be removed, and the image carrier may be made available for further imaging cycle.

According to another aspect, the present disclosure provides a toner supplying unit, including: a toner tank in which toner may be stored; a supplying part protruding from an inner surface of the toner tank to externally supply toner from the toner tank; and a toner-agitating member rotatably disposed inside the toner tank to agitate toner in almost the entire inner space of the toner tank including a space above a top surface of the supplying part, wherein the electrophotographic toner described herein, including a binder, a colorant and a releasing agent, may be used.

FIG. 1 is a view of the toner supplying unit 100 according to an embodiment of the present disclosure.

The toner supplying unit 100 may include a toner tank 101, a supplying part 103, a toner-conveying member 105 and a toner-agitating member 110. The toner tank 101 is configured to store therein a predetermined amount of toner, and may have a substantially hollow cylindrical shape. The supplying part 103 may be disposed on an inner bottom surface of the toner tank 101, and may be configured to externally discharge toner contained in the toner tank 101. For example, the supplying part 103 may protrude from the bottom of the toner tank 101 to have a pillar shape with a semi-circular cross-section. The supplying part 103 may include a toner outlet (not shown) in an outer side thereof, through which toner outlet the toner may be discharged. The toner-conveying member 105 may be disposed at a side of the supplying part 103 on the inner bottom surface of the toner tank 101. The toner-conveying member 105 may have, for example, a coil spring shape. An end of the toner-conveying member 105 may extend inside the supplying part 103 so that toner in the toner tank 101 is conveyed into the supplying part 103 as the toner-conveying member 105 rotates. Toner conveyed by the toner-conveying member 105 may be externally discharged through the toner outlet of the supplying part 103.

The toner-agitating member 110 is rotatably disposed inside the toner tank 101 and forces toner in the toner tank 101 to move in a radial direction. For example, when the toner-agitating member 110 rotates at the middle of the toner tank 101, toner in the toner tank 101 is agitated to prevent toner from solidifying. As a result, toner moves down to the bottom of the toner tank 101 due to gravity. The toner-agitating member 110 includes a rotation shaft 112 and a toner-agitating film 120. The rotation shaft 112 is rotatably disposed at the middle of the toner tank 101, and may have a driving gear (not shown) that may be coaxially coupled with an end of the rotation shaft 112 protruding from the side of the toner tank 101. Therefore, the rotation of the driving gear causes the rotation shaft 112 to rotate. Also, the rotation shaft 112 may have a support plate 114 to help fix toner-agitating film 120 to the rotation shaft 112. The support plate 114 may be formed to be substantially symmetric about the rotation shaft 112. The toner-agitating film 120 has the width corresponding to the inner length of the toner tank 101. The toner-agitating film 120 may be elastically deformable in consideration of the shape of the projection inside the toner tank 101, i.e., the supply part 103. The toner-agitating film 120 may include a first agitating part 121 and a second agitating part 122 formed by cutting an end of the toner-agitating film 120 toward the rotation shaft 112 by a predetermined length.

According to another aspect, present disclosure provides an imaging apparatus including: an image carrier; an imaging unit forming an electrostatic image on the surface of the image carrier; a unit containing toner; a toner supplying unit supplying toner to the surface of the image carrier to develop the electrostatic image into a toner image; and a toner transfer unit transferring the toner image formed on the surface of the image carrier to a transfer medium, wherein the electrophotographic toner described herein, including a binder, a colorant and a releasing agent, may be used.

Figure 2:
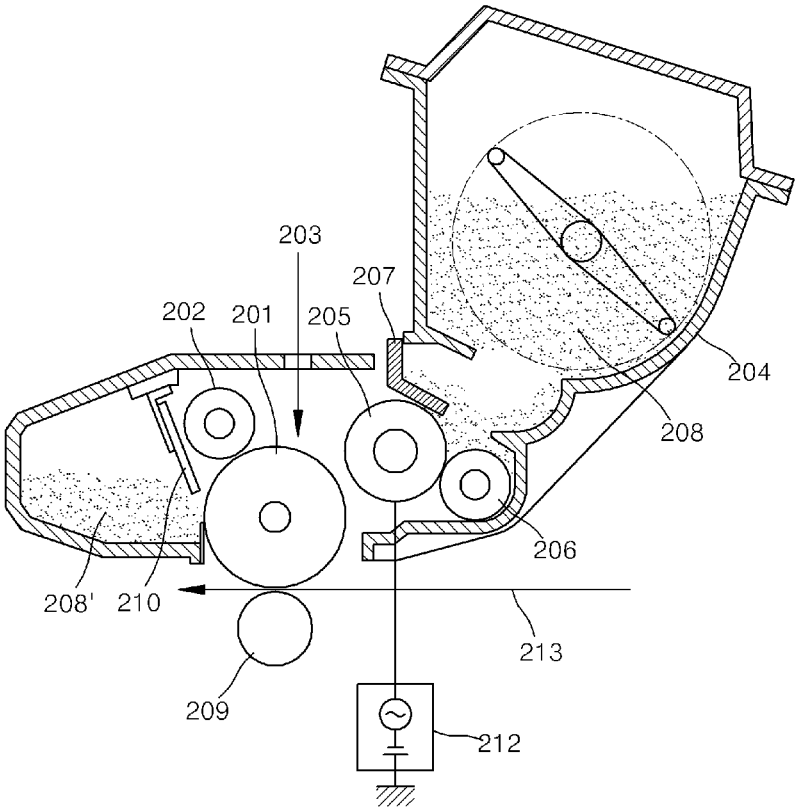
FIG. 2 is a schematic view of an imaging apparatus utilizing toner.

FIG. 2 is a schematic view of a non-contact development type imaging apparatus utilizing toner prepared by a method according to an embodiment of the present disclosure.

A non-magnetic one-component developer, i.e., toner 208, in the developing device 204 is supplied to the developing roller 205 by the supply roller 206 formed of an elastic material, such as polyurethane foam or sponge. The toner 208 supplied onto the developing roller 205 reaches the contact portion between the developer-regulating blade 207 and the developing roller 205 as the developing roller 205 rotates. The developer-regulating blade 207 may be formed of an elastic material, such as metal or rubber. When the toner 208 passes through the contact portion between the developer-regulating blade 207 and the developing roller 205, the amount of toner 208 may be regulated to be a thin layer of uniform thickness, and may also be sufficiently charged. The toner 208, which has been formed into a thin layer, is transferred to the development region of the photoreceptor 201 where the latent image on the surface of the photoreceptor 201 is developed with the toner supplied by the developing roller 205, wherein the photoreceptor 201 is an example of an image carrier. As previously described, the electrostatic latent image is formed by scanning light 203 onto the photoreceptor 201

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction while the photoreceptor 201 may rotate in a clockwise direction.

Toner 208, which has been transferred to the development region of the photoreceptor 201, develops the latent image formed on the photoreceptor 201 into the toner image using an electrostatic force generated due to the potential difference between a direct current (DC)-biased alternating current (AC) voltage applied to the developing roller 205 and the latent potential of the photoreceptor 201 charged by the charging unit 202.

Toner image, which has been developed on the photoreceptor 201, reaches the transfer unit 209 as the photoreceptor 201 rotates. Toner image, which has been developed on the photoreceptor 201, is transferred to the print medium 213 when the print medium 213 passes between the photoreceptor 201 and the transfer unit 209 by the transfer unit 209 having a roller shape and to which a high voltage having a polarity opposite to toner 208 is applied.

Toner image transferred to the print medium 213 passes through a high-temperature, high-pressure fusing device (not shown) and thus, is fused to the print medium 213, thereby resulting in the fixed image. The non-developed, residual developer 208' on the developing roller 205 is collected by the supply roller 206 contacting the developing roller 205 whereas the non-developed, residual developer 208' on the photoreceptor 201 is collected by the cleaning blade 210. The processes described herein may be repeated for formation of subsequent images.

EXAMPLES

For further illustration of various aspects of the present disclosure, several specific examples will now be described. It should be understood however that these examples are for illustrative purposes only, and are not intended to limit the scope of the present disclosure.

Scanning electron microscopic (SEM) images of toners prepared according to the following examples were obtained to identify shapes of toners. The circularity of toners was obtained using an FPIA-3000 (SYSMEX Corp.), and using the equation below:

$$\text{Circularity}=2\times(\pi\times\text{area})^{0.5}/\text{circumference}.$$

The circularity may be in the range of 0 to 1, and as the circularity approaches 1, toner particle shape becomes more circular.

The physical properties of amorphous and crystalline polyester resins used in the following preparation examples are shown in Tables 2 and 3.

TABLE 2

| Crystalline polyester resin | Mw | Melting temperature ($T_m$, ° C.) | Acid value (mgKOH/g) |
|---|---|---|---|
| C-1 | 14,100 | 65 | 5.9 |
| C-2 | 21,400 | 76 | 9.8 |
| C-3 | 9,800 | 62 | 4.1 |
| C-4 | 33,000 | 81 | 16.2 |

TABLE 3

| Amorphous polyester resin | Mw | Glass transition temperature $T_g$(° C.) | Acid value (mgKOH/g) |
|---|---|---|---|
| A-1 | 15,500 | 57 | 14.9 |
| A-2 | 12,300 | 65 | 12.9 |
| A-3 | 17,200 | 54 | 18.9 |
| A-4 | 11,300 | 68 | 7.9 |

In Tables 2 and 3, 'Mw' denotes the weight average molecular weight of each of the polyester resins measured as the weight average molecular weight of the tetrahydrofuran (THF) component of the polymer resins by gel permeation chromatography (GPC).

The acid values of polyester resins in Tables 2 and 3 were measured by the following method. About 1 g of polyester resin was put into a 200-ml bottle, and 120 ml of THF was added to dissolve the polyester resin. 30 ml of ethanol was further added into the polyester resin solution and thoroughly mixed. After addition of 3 to 5 droplets of phenolphthalein as an indicator into the polyester resin solution, the polyester resin solution was titrated with 0.1N KOH solution. The volume of the 0.1 N KOH titrant added was read when the color change of the polyester resin solution to red remains for about 30 seconds. Apart from this, a mixed solution of a 120-ml THF and a 30-ml ethanol was titrated with 0.1 N KOH titrant (to conduct a blank test). The acid value was calculated by the following equation:

$$\text{Acid Value}=(V-B)\times C\times 56.11/M$$

wherein V=Volume of KOH added to titrate the polyester resin solution (mL); B=Volume of KOH added to titrate the blank solution (mL); C=Concentration of KOH(N); and M=Weight of a sample (g).

Preparation Example 1-1

Preparation of Latex A-1 Containing Binder A-1

500 g of polyester resin A-1, 400 g of methyl ethyl ketone (MEK), and 100 g of isopropyl alcohol (IPA) were placed in a 3 L double-jacketed reactor, and were dissolved at 30° C. while stirring with a mechanical anchor-type stirrer to obtain a polyester resin solution. 10% of aqueous ammonia solution was slowly added to the polyester resin solution while stirring, and 1,500 g of water was further added at a rate of 50 g/min with continuously stirring to prepare an emulsion. The solvent was removed from the emulsion by distillation at reduced pressure to obtain latex A-1 having a 25% solid content. The solid component was named binder A-1.

Preparation Example 1-2

Preparation of Latex A-2 Containing Binder A-2

Latex A-2 having a 25% solid content was prepared in the same manner as in Preparation Example 1-1, except that polyester resin A-2 was used instead of polyester resin A-1, and a 10% aqueous ammonia solution was added to a pH of 7-8. The solid component was named binder A-2.

Preparation Example 1-3

Preparation of Latex A-3 Containing Binder A-3

Latex A-3 having a 25% solid content was prepared in the same manner as in Preparation Example 1-1, except that polyester resin A-3 was used instead of polyester resin A-1, and a 10% aqueous ammonia solution was added to a pH of 7-8. The solid component was named binder A-3.

Preparation Example 1-4

Preparation of Latex A-4 Containing Binder A-4

Latex A-4 having a 25% solid content was prepared in the same manner as in Preparation Example 1-1, except that polyester resin A-4 was used instead of polyester resin A-1, and a 10% aqueous ammonia solution was added to a pH of 7-8. The solid component was named binder A-4.

Preparation Example 2-1

Preparation of Latex C-1 Containing Binder C-1

Latex C-1 having a 25% solid content was prepared in the same manner as in Preparation Example 1-1, except that polyester resin C-1 was used instead of polyester resin A-1, and a 10% aqueous ammonia solution was added to a pH of 7-8. The solid component was named binder C-1.

Preparation Example 2-2

Preparation of Latex C-2 Containing Binder C-2

Latex C-2 having a 25% solid content was prepared in the same manner as in Preparation Example 1-1, except that polyester resin C-2 was used instead of polyester resin A-1, and a 10% aqueous ammonia solution was added to a pH of 7-8. The solid component was named binder C-2.

Preparation Example 2-3

Preparation of Latex C-3 Containing Binder C-3

Latex C-3 having a 25% solid content was prepared in the same manner as in Preparation Example 1-1, except that polyester resin C-3 was used instead of polyester resin A-1, and a 10% aqueous ammonia solution was added to a pH of 7-8. The solid component was named binder C-3.

Preparation Example 2-4

Preparation of Latex C-4 Containing Binder C-4

Latex C-4 having a 25% solid content was prepared in the same manner as in Preparation Example 1-1, except that polyester resin C-4 was used instead of polyester resin A-1, and a 10% aqueous ammonia solution was added to a pH of 7-8. The solid component was named binder C-4.

Preparation Example 3

Preparation of Colorant Dispersion 10 g in total of an anionic reactive emulsifier (HS-10; Dai-lchi Kogyo Seiyaku Co., Ltd.) and a nonionic reactive emulsifier (RN-10; Dai-lchi Kogyo Seiyaku Co., Ltd.) in a 1:1 ratio by weight were added to a milling bath, together with 60 g of a colorant (cyan, PB15:4), 400 g of glass beads each having a diameter of about 0.8 to about 1 mm were added thereto, and milling was performed thereon at room temperature to prepare a colorant dispersion. The homogenizer used in this experiment was an ultrasonic homogenizer or a micro fluidizer.

Preparation Example 4

Preparation of Releasing Agent Dispersion

P-280 (about 83% of paraffin wax, about 17% of synthetic ester wax; $T_m$ 75° C.), available from Chukyo Yushi Co., Ltd., was used as the releasing agent dispersion.

Example 1

316 g of deionized water, 250 g of amorphous latex A-1 having a 25% solid content prepared in Preparation Example 1-1, and 57 g of crystalline latex C-1 having a 25% solid content prepared in Preparation Example 2-1, wherein amorphous latex A-1 and crystalline latex C-1 function as primary binder particles constituting cores, were placed in a 1 L reactor, and were stirred at 350 rμm. 35 g of 19.5% cyan colorant dispersion (HS-10 100%) prepared in Preparation Example 3 and 28 g of 35% releasing agent dispersion P-280 (Chukyo Yushi Co., Ltd.) prepared in Preparation Example 4 were added thereto to obtain a mixed solution. 30 g (0.3 mol) of a nitric acid, and 15 g of 12% PSI-100 (available from Suido Kiko Co., Ltd. of Tokyo, Japan) as an agglomerating agent were added to the mixed solution, stirred using a homogenizer at a rate of 11,000 rμm, and heated stepwise up to 50° C. (by 1° C./min). The reaction product was further agglomerated while raising temperature at a rate of 0.03° C./min to obtain core-layer particles having a volume average diameter of about 4 to about 5 μm.

150 g of latex 4-1 having a 25% solid content prepared in Preparation Example 1-4 was added as secondary binder particles and reacted for 0.5 hour. 1 mol of NaOH was added to adjust pH of the reaction product to 7.5-9 and left for 20 minutes. The temperature was raised up to 95° C. at a rate of 0.5° C./min to fuse the particles for 3 hours to a volume average diameter of about 5 to about 7 μm. The agglomerated reaction solution was cooled to a temperature lower than Tg, and was filtered to isolate toner particles, followed by drying.

0.5 parts by weight of NX-90 (available from Nippon Aerosil Co., Ltd. of Osaka, Japan), 1.0 part by weight of RX-200 (Nippon Aerosil Co., Ltd.), and 0.5 parts by weight of SW-100 (available from Titan Kogyo Kabushiki Kaisha of Ube, Japan) were externally added to 100 parts by weight of the dried toner particles and stirred using a mixer (KM-LS2K, available from DAEWHA TECH Co., Ltd. of Yong-In, South Korea) at a rate of 8,000 rμm for 4 minutes. As a result, toner having a potato-like shape and a volume average particle diameter of 5.84 μm was obtained. The toner had a GSDp of 1.20 and a GSDv of 1.23. The average circularity of toner was 0.972.

Example 2

Toner having a potato-like shape was prepared in the same manner as in Example 1, except that 250 g of amorphous latex A-2 having a 25% solid content prepared in Preparation Example 1-2 and 59 g of crystalline latex C-2 having a 25% solid content prepared in Preparation Example 2-2 were used as primary binder particles. The toner had a volume average particle diameter of 5.68 μm. The toner had a GSDp of 1.23 and a GSDv of 1.22. The average circularity of toner was 0.974.

Comparative Example 1

Toner having a potato-like shape was prepared in the same manner as in Example 1, except that 250 g of amorphous latex A-3 having a 25% solid content prepared in Preparation Example 1-3 and 57 g of crystalline latex C-3 having a 25% solid content prepared in Preparation Example 2-3 were used as primary binder particles. The toner had a volume average particle diameter of 5.94 μm. The toner had a GSDp of 1.24 and a GSDv of 1.25. The average circularity of toner was 0.969.

Comparative Example 2

Toner having a potato-like shape was prepared in the same manner as in Example 1, except that 250 g of amorphous latex A-4 having a 25% solid content prepared in Preparation Example 1-4 and 57 g of crystalline latex C-4 having a 25% solid content prepared in Preparation Example 2-4 were used as primary binder particles. The toner had a volume average particle diameter of 5.70 μm. The toner had a GSDp of 1.24 and a GSDv of 1.23. The average circularity of toner was 0.973.

Comparative Example 3

Toner having a potato-like shape was prepared in the same manner as in Example 1, except that 250 g of amorphous latex A-4 having a 25% solid content prepared in Preparation Example 1-4 and 57 g of crystalline latex C-1 having a 25% solid content prepared in Preparation Example 2-1 were used as primary binder particles. The toner had a volume average particle diameter of 5.80 μm. The toner had a GSDp of 1.21 and a GSDv of 1.22. The average circularity of toner was 0.975.

Evaluation of Toner: Analysis of Toner's Cross-Section

After being stained with ruthenium tetraoxide ($RuO_4$), toner particles were molded using epoxy resin and were sliced using an ultramicrotome (Power TOME XL, manufactured by RMC) to a cross-section. The cross-section was observed using a transmission electron microscope (TEM) (Technai F20st, manufactured by TITAN) at a vacuum pressure of 10 to 4 Pa or greater and an accelerated voltage of 10 to 30 kV.

Measurement of Weight Average Molecular Weight and Molecular Weight Distribution Weight average molecular weight (Mw) of toner was measured by a GPC chromatogram (Waters 2414). The refractive index and multi-angle light scattering (MALS) were used as a detector, and three columns, Strygel HR 5, 4, and 2, were used.

Gloss Evaluation

This experiment was performed using a glossmeter (micro-TRI-gloss available from BYK-Gardner of Columbia, Md., U.S.A.) at a temperature of 160° C. at which the fixing device was used. Measurement angle: 60° and Measured pattern: 100% pattern.

Fixing Characteristics Evaluation

Equipment: Belt-type fixing device (Color Laser 660, available from Samsung Electronics Co., Ltd. of Seoul, South Korea).

Unfixed image for testing: 100% pattern

Test temperature: 100~180° C. (10° C. interval)

Test medium: 60 g paper sheet (X-9, available from Boise, Inc. of Boise, Id., U.S.A.), and 90 g paper sheet (Xerox Exclusive, available from Xerox Corp. of Norwalk, Conn., U.S.A.)

Fusing dwell rate: 160 mm/sec

Fusing dwell time: 0.08 sec

This experiment was performed under the conditions described herein, and the fixability of the fixed image was evaluated in the following manner. Optical density (OD) of the fixed image was measured and a 3M 810 tape was attached to the fixed image and 500 g of weight was reciprocated thereon five times and the tape used was removed. The OD of the fixed image was measured.

Fixability(%)=(OD after peeling off the tape)/(OD before peeling off the tape)×100.

A fusing temperature range in which fixability is 90% or more is defined as the fusing latitude of toner.

MFT: Minimum Fusing Temperature (minimum temperature at which the fixability is 90% or more without occurrence of cold-offset)

HOT: Hot-Offset Temperature (minimum temperature at which hot-offset occurs)

Evaluation of Charging Characteristics of Toner 28.5 g of a carrier and 1.5 g of toner were placed into 60 mL of a glass container and the mixture was stirred using a turbula mixer. The amount of toner charged was measured by electric field separation.

Toner charging stability with respect to mixing for an hour at room temperature and room humidity, and the ratio of the amount of toner charged at high-temperature and high-humidity to the amount of toner charged at low-temperature and low-humidity ratio were used as evaluation criteria.

Room temperature, Room humidity: 23° C., RH 55%

High temperature, High humidity: 32° C., RH 80%

Low temperature, Low humidity: 10° C., RH 10%

* Charging Stability

○: A charge saturation curve with respect to mixing time is smooth and its variation is negligible after charge saturation.

◇: A charge saturation curve with respect to mixing time is slightly un-uniform, or a small change occurs after charge saturation (maximum 30%).

X: Charging with respect to mixing time is not saturated, or a change occurs after charge saturation (30% or more).

* HH/LL ratio

○: 0.55 or greater

Δ: 0.45~0.55

X: less than 0.45

Toner Flowability Evaluation (Carr's Cohesion

Apparatus: Hosokawa micron powder tester PT-S

Sample amount: 2 g (Toner that contains or does not contain external additive)

Amplitude: 1 mm_Dial 3-3,5

Sieve size: 53 μm, 45 μm, 38 μm

Vibration time: 120 seconds

After being stored at 23° C. and a relative humidity (RH) of 55% for 2 hours, the amount of toner in each of the sieves was measured before and after sieving to calculate the degree of cohesion (Carr's Cohesion).

(1) [(Mass of toner powder in the largest sieve)/2 g]×100

(2) [(Mass of toner powder in the middle sieve)/2 g]×100×(3/5)

(3) [(Mass of toner powder in the smallest sieve)/2 g]×100×(1/5) Carr's Cohesion=(1)+(2)+(3)

Flowability Evaluation Criteria

Δ: Carr's Cohesion is 10 or less, and flowability is very good

○: Carr's Cohesion is 10-20, and flowability is good

◇: Carr's Cohesion is 20-40, and flowability is slightly poor

X: Carr's Cohesion is 40 or greater, and flowability is poor

Evaluation of High-temperature Preservation Characteristics 100 g of toner containing external additives was loaded into a developing unit (Color laser 660 fixing device, Samsung Electronics Co., Ltd.) and stored as a package in a constant-temperature and constant-humidity oven under the following conditions.

23° C., 55% RH, 2 hours

=>40° C., 90% RH, 48 hours

=>50° C., 80% RH, 48 hours

=>40° C., 90% RH, 48 hours

=>23° C., 55% RH, 6 hours

After being stored under the conditions described herein, whether toner caking occurred in the developing unit was observed by visual inspection, and a 100% image was output to evaluate whether the image was defective.

TABLE 4

| | DS(R)/ DL(R) | DS(C)/ DL(C) | Rκ/R | $C_\lambda$/C | (Rκ+ $C_\lambda$)/ T | Gloss | Fixing Characteristic MFT | Fixing Characteristic HOT | Charging Characteristic Stability | Charging Characteristic HH/LL | Flow-ability | High-temp. Preservation Characteristic |
|---|---|---|---|---|---|---|---|---|---|---|---|---|
| Ex. 1 | 0.65 | 0.45 | 0.6 | 0.33 | 0.27 | 11.6 | 120° C. | 180° C. or higher | ○ | ○ | ○ | ○ |
| Ex. 2 | 0.72 | 0.53 | 0.5 | 0.31 | 0.24 | 10.9 | 130° C. | 180° C. or higher | ○ | ○ | ○ | ○ |
| Comp. Ex. 1 | 0.35 | 0.05 | 0.42 | 0.22 | 0.19 | 8.9 | 100° C. | 170° C. | ○ | X | ○ | ○ |
| Comp. Ex. 2 | 0.31 | 0.03 | 0.38 | 0.17 | 0.18 | 7.2 | 150° C. | 180° C. or higher | ◇ | Δ | ○ | ◇ |
| Comp. Ex. 3 | 0.40 | 0.08 | 0.28 | 0.09 | 0.11 | 6.1 | 120° C. | 170° C. | ◇ | ○ | X | ◇ |

Evaluation criteria

○: Image quality is good, and no caking occurs.

◇: Image quality is poor, and no caking occurs.

Caking occurs.

Referring to Table 4 herein, for the toners of Examples 1 and 2 in which the shapes and areas of the crystalline polyester resin domains (C) and the releasing agent domains (R), and their ratio to the entire area (T) of the cross-section of toner were within appropriate ranges, the gloss, charging stability, flowability, storage stability, and low-temperature fixability were all excellent without any problem. However, for the toner of Comparative Example 1 in which the ratios of Rκ/R and $C_\lambda$/C were not within an appropriate range, the charging characteristics and fusing behavior (HOT) were poor. For the toner of Comparative Example 2 in which the ratios of the crystalline polyester resin domains (C) and the releasing agent domains (R) to the entire area of the toner cross-section were not within an appropriate range, the flowability and charging stability were poor, and the fusing latitude was narrow. For the toner of Comparative Example 3 in which the ratios of Rκ/R, $C_\lambda$/C, and (RκK+$C_\lambda$)/T were not within the appropriate ranges, the gloss, stability to frictional charges, flowability, and storage characteristics were degraded.

As described herein, the disclosure provides an electrophotographic toner that has excellent anti-offset characteristics, charge stability, low-temperature fixability, storage stability, and gloss, and which is suitable for use in an electrophotocopier, laser printer, electrostatic recording device or the like. Such an electrographic toner is prepared by controlling the morphology of toner including crystalline polyester resin domains, amorphous polyester resin domains, and releasing agent domains, and controlling the difference between the acid values of these domains.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. An electrophotographic toner comprising:

a binder containing a crystalline polyester resin and an amorphous polyester resin;

a colorant; and a releasing agent, wherein the areas and shapes of the crystalline polyester resin domains and releasing agent domains in a total cross-section of toner satisfy the following inequalities (1)-(5), wherein the cross-section of toner is observed by transmission electron microscopy (TEM) after being stained with ruthenium tetraoxide ($RuO_4$):

$$0.6 \leq DS(R)/DL(R) \leq 0.8 \quad (1)$$

$$0.3 < DS(C)/DL(C) \leq 0.53 \quad (2)$$

$$0.45 \leq R\kappa/R \leq 0.9 \quad (3)$$

$$0.25 \leq C_\lambda / C \leq 0.9 \quad (4)$$

$$0.2 \leq (R\kappa + C_\lambda)/T \leq 0.4 \quad (5),$$

wherein DS(R) and DL(R) denote the shortest and longest diameters, respectively, of the releasing agent domains; and DS(C) and DL(C) denote the shortest and longest diameters, respectively, of the crystalline polyester resin domains, and wherein R, Rκ, C, $C_\lambda$ and T denote the total area of the entire releasing agent domains, the total area of the releasing agent domains which satisfy the inequality (1), the total area of the entire crystalline polyester resin domains, the total area of the crystalline polyester resin domains which satisfy the inequality (2), and the total area of the entire cross-section of toner, respectively, wherein the electrophotographic toner includes iron (Fe) and silicon (Si), wherein the [Si]/[Fe] ratio is in the range of about $5.0\times10^{-4}$ to about $5.0\times10^{-2}$, wherein [Fe] and [Si] denote the intensities of Fe and Si, respectively, as measured by X-ray fluorescence spectrometry, wherein the difference between the amorphous polyester resin's acid value (AV) and the crystalline polyester resin's AV satisfies the following inequality (6):

$$2 \leq \text{amorphous polyester resin's } AV - \text{crystalline polyester resin's } AV \leq 15 \quad (6),$$

wherein the amorphous polyester resin's AV and the crystalline polyester resin's AV means the number of milligrams (mg) of KOH required to neutralize 1 g of each of the amorphous polyester resin and the amorphous polyester resin; and the difference (SPB-SPR) between the solubility parameter of the binder (SPB) and the solubility parameter of the releasing agent (SPR) is about 2 or greater.

2. The electrophotographic toner of claim 1, wherein the volume average particle diameter of the electrophotographic toner is in the range of about 3 to about 9.5 μm.

3. The electrophotographic toner of claim 1, wherein an average circularity of the electrophotographic toner is in the range of about 0.945 to about 0.985.

4. The electrophotographic toner of claim 1, wherein the volume average particle diameter distribution coefficient (GSDv) of the toner is about 1.25 or less, and the number average particle diameter distribution coefficient (GSDp) is about 1.3 or less.

5. The electrophotographic toner of claim 1, wherein, when the particle diameter distribution of the electrophotographic toner is measured by the Coulter method, the electrophotographic toner contains less than 3 wt % of fine particles having a volume average particle diameter of less than 3 μm, and less than 0.5 wt % of coarse particles having a volume average particle diameter of 16 μm or greater.

6. The electrophotographic toner of claim 1, wherein the main endothermic peak of the electrophotographic toner appears at a temperature of about 50 to about 150° C., as measured by differential scanning calorimetry(DSC) according to ASTM D-3418-8.

7. The electrophotographic toner of claim 1, wherein the releasing agent comprises a paraffin-based wax and an ester-based wax.

8. The electrophotographic toner of claim 7, wherein the ester-based wax is in the range of about 1 to about 35 parts by weight % based on the total weight of the paraffin-based wax and the ester-based wax.

9. A method of preparing an electrophotographic toner, the method comprising:

mixing primary binder particles, a colorant dispersion and a releasing agent dispersion together to thereby produce a mixed solution;

adding an agglomerating agent to the mixed solution to thereby produce core-layer particles; and coating the core-layer particles with shell-layer particles comprising secondary binder particles to thereby produce toner particles, wherein the secondary binder particles are prepared by polymerizing at least one polymerizable monomer, wherein the electrophotographic toner comprises the electrophotographic toner of claim 1.

10. The method of claim 9, wherein the producing of the toner particles comprises:

a) agglomerating the core-layer particles and the shell-layer particles at a temperature at which the core-layer particles and the shell-layer particles have a shear storage modulus (G') of about $1.0\times10^8$ to about $1.0\times10^9$ Pa;

b) stopping the agglomerating of operation a) when an average particle diameter of the toner particles reaches about 70 % to about 100 % of the average particle diameter of toner particles; and c) fusing and coalescing the toner particles obtained in operation b) at a temperature at which the toner particles obtained in operation b) have a shear storage modulus (G') of about $1.0\times10^4$ to about $1.0\times10^9$ Pa.

11. The method of claim 9, further comprising coating the toner particles with tertiary binder particles.

12. The method of claim 9, wherein the releasing agent dispersion comprises a paraffin-based wax and an ester-based wax.

13. The method of claim 12, wherein the ester-based wax is in the range of about 1 to about 35 parts by weight % based on the total weight of the paraffin-based wax and the ester-based wax.

14. The method of claim 9, wherein the agglomerating agent comprises a Si- and Fe-containing metal salt.

15. The method of claim 9, wherein the agglomerating agent comprises polysilicate iron.

* * * * *